US011149477B2

(12) United States Patent
Doerflinger

(10) Patent No.: US 11,149,477 B2
(45) Date of Patent: Oct. 19, 2021

(54) LATCH AND METHOD OF INSTALLING A LATCH

(71) Applicant: SNAP-ON INCORPORATED, Kenosha, WI (US)

(72) Inventor: David A. Doerflinger, Franksville, WI (US)

(73) Assignee: SNAP-ON INCORPORATED, Kenosha, WI (US)

( * ) Notice: Subject to any disclaimer, the term of this patent is extended or adjusted under 35 U.S.C. 154(b) by 0 days.

(21) Appl. No.: 15/636,143

(22) Filed: Jun. 28, 2017

(65) Prior Publication Data

US 2019/0003219 A1 Jan. 3, 2019

(51) Int. Cl.

| | |
|---|---|
| ***E05B 65/46*** | (2017.01) |
| ***E05C 19/10*** | (2006.01) |
| ***E05C 3/14*** | (2006.01) |

(52) U.S. Cl.

CPC ..... *E05C 19/10* (2013.01); *E05B 65/46* (2013.01); *E05C 3/14* (2013.01)

(58) Field of Classification Search

CPC ..... E05C 19/10; E05B 65/46

See application file for complete search history.

(56) References Cited

U.S. PATENT DOCUMENTS

| | | | | |
|---|---|---|---|---|
| 2,470,927 | A | | 5/1949 | Hale, Jr. |
| 2,575,311 | A | | 11/1951 | Barry, Jr. et al. |
| 2,853,114 | A | | 9/1958 | Barry |
| 3,156,152 | A | * | 11/1964 | Reed ..... F16B 15/06 411/386 |
| 4,167,802 | A | | 9/1979 | Rock et al. |
| 4,768,259 | A | | 9/1988 | Rock et al. |
| 4,982,476 | A | | 1/1991 | Salice |
| 5,361,478 | A | | 11/1994 | Grossberndt et al. |
| 5,966,779 | A | | 10/1999 | Salice |
| 6,223,394 | B1 | | 5/2001 | Salice |
| 6,267,421 | B1 | | 7/2001 | Burton |
| 6,273,480 | B1 | | 8/2001 | Burton |
| 6,454,321 | B1 | | 9/2002 | Parikh |
| 6,601,885 | B1 | | 8/2003 | Yiu |

(Continued)

FOREIGN PATENT DOCUMENTS

| | | |
|---|---|---|
| CN | 201468549 U | 5/2010 |
| CN | 201744989 | 2/2011 |

(Continued)

OTHER PUBLICATIONS

Combined Search and Examination Report dated Oct. 10, 2018, 8 pages.

(Continued)

*Primary Examiner* — Kristina R Fulton
*Assistant Examiner* — Thomas L Neubauer
(74) *Attorney, Agent, or Firm* — Seyfarth Shaw LLP

(57) ABSTRACT

Disclosed are latches with pre-molded or pre-assembled fasteners. The latch fastener can include a threaded portion and a lead in portion that is longer than the threaded portion. During installation of the latch, the lead in portion can be inserted into a cavity of a drawer to help align the latch against the cavity during installation. The built-in fastener frees one hand of the user during installation and the additional length of the lead in allows an easier alignment of the latch during installation.

13 Claims, 7 Drawing Sheets

(56) References Cited

U.S. PATENT DOCUMENTS

| | | | | |
|---|---|---|---|---|
| 2003/0086753 | A1* | 5/2003 | Trotter | B29C 45/14754 403/122 |
| 2008/0222873 | A1* | 9/2008 | Draht | F16B 19/14 29/432 |
| 2011/0121701 | A1* | 5/2011 | Chang | E05B 7/00 312/332.1 |
| 2011/0309730 | A1* | 12/2011 | Retchloff | E05B 65/46 312/332.1 |
| 2014/0339974 | A1 | 11/2014 | Gill et al. | |
| 2017/0150815 | A1 | 6/2017 | Zhang | |

FOREIGN PATENT DOCUMENTS

| | | | | |
|---|---|---|---|---|
| GB | 2116279 | A | 9/1983 | |
| TW | 200522895 | | 7/2005 | |
| TW | 1327899 | | 8/2010 | |
| TW | 201619483 | | 6/2016 | |
| WO | WO-9011458 | A1 * | 10/1990 | F16B 25/0021 |
| WO | 2004044356 | A | 5/2004 | |

OTHER PUBLICATIONS

Taiwan Office Action for Application No. 107122033 dated Jan. 15, 2019, 7 pages.

Australian Examination Report No. 1 for Application No. 2018202541 dated Feb. 14, 2019, 3 pages.

Canadian Office Action for Application No. 3,004,216 dated Jan. 28, 2019, 3 pages.

United Kingdom Examination Report for Application No. GB1806151.5, dated Aug. 9, 2019, 6 pages.

Taiwan Office Action for Application No. 107122033, dated Oct. 15, 2019, 8 pages.

Examination Report for Application No. GB1806151.5 dated Feb. 20, 2020, 2 pages.

Examination Report for United Kingdom Application No. GB1806151.5 dated Feb. 20, 2020, 2 pages.

United Kingdom Examination Report for Application No. GB1806151.5, dated Nov. 15, 2019, 4 pages.

Canadian Office Action for Application No. 3,004,216, dated Nov. 20, 2019, 4 pages.

Chinese Office Action for Application No. 2018106732228, dated Nov. 28, 2019, 10 pages.

Taiwan Officer Action for Application No. 107122033 dated Jun. 8, 2020, 8 pages.

Chinese Office Action for Application No. 201810673222.8 dated Jan. 29, 2021, 11 pages.

Australian Examination Report No. 1 for corresponding Australian Application No. 2020203100 dated May 11, 2021, 5 pages.

Chinese Office Action for corresponding Application No. 201810673222.8 dated May 8, 2021, 6 pages.

* cited by examiner

LATCH AND METHOD OF INSTALLING A LATCH

TECHNICAL FIELD OF THE INVENTION

The present invention relates generally to latches. More particularly, the present invention relates to latches and methods of installing latches with pre-molded or pre-coupled fasteners.

BACKGROUND OF THE INVENTION

Tool boxes and other enclosures include drawers for holding tools or fasteners. These drawers typically include slides that allow the drawer to slide into and out of the cabinet along rails. When in the closed position, the drawer latches shut with a latch that is spring-biased into a locked position. For example, as shown in FIG. 7, the system 700 includes a latch 705 and fastener 710 that can be coupled to a drawer 712 with a handle 715 and cavity 720. The latch 705 is spring-biased so that the hook of the latch 705 catches on the cabinet and maintains the latch 705 in the locked position when the drawer 712 is shut.

The latch 705 can be pressed against the cavity 720 and aligned with a screw boss or other receiving portion during assembly. A user can then couple the latch 705 to the drawer 712 by holding the latch 705 against the drawer 712 and screwing or otherwise assembling the fastener 710.

SUMMARY OF THE INVENTION

The present invention broadly includes a latch body with a pre-molded or pre-assembled fastener in the latch body to provide a latch that is easier to install, compared to prior art latches. Further, the latch fastener can include a threaded portion and a lead in portion that is longer than the threaded portion. The lead in portion can therefore be used to align the latch against the cavity during installation and the built-in nature of the fastener allows the user to free one hand during installation rather than guide the fastener through the latch and into the cavity.

In particular, the present invention broadly includes a method of installing a latch where the method includes providing a latch including a cover plate, a hook extending from a cover plate, and a fastener coupled to the cover plate. The fastener includes a threaded portion and a lead in portion, and the lead in portion is longer than the threaded portion. The method further includes aligning the latch against the drawer with the lead in portion, and coupling the fastener to a drawer by engaging the fastener into the drawer.

In another embodiment, the present invention broadly includes a latch including a cover plate, a hook extending from a cover plate and adapted to engage with a catch of a cabinet, and a fastener coupled to the cover plate. The fastener includes a threaded portion and a lead in portion, where the lead in portion is longer than the threaded portion. A spring can also be provided and can bias the latch into a locked position when the latch is engaged against the catch.

In yet another embodiment, the present invention broadly comprises a latch including a cover plate, a hook extending from the cover plate that is adapted to engage with a catch of a cabinet, and a fastener pre-molded to the cover plate. The latch can further include a spring adapted to bias the latch into a locked position when the latch is engaged against the catch.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
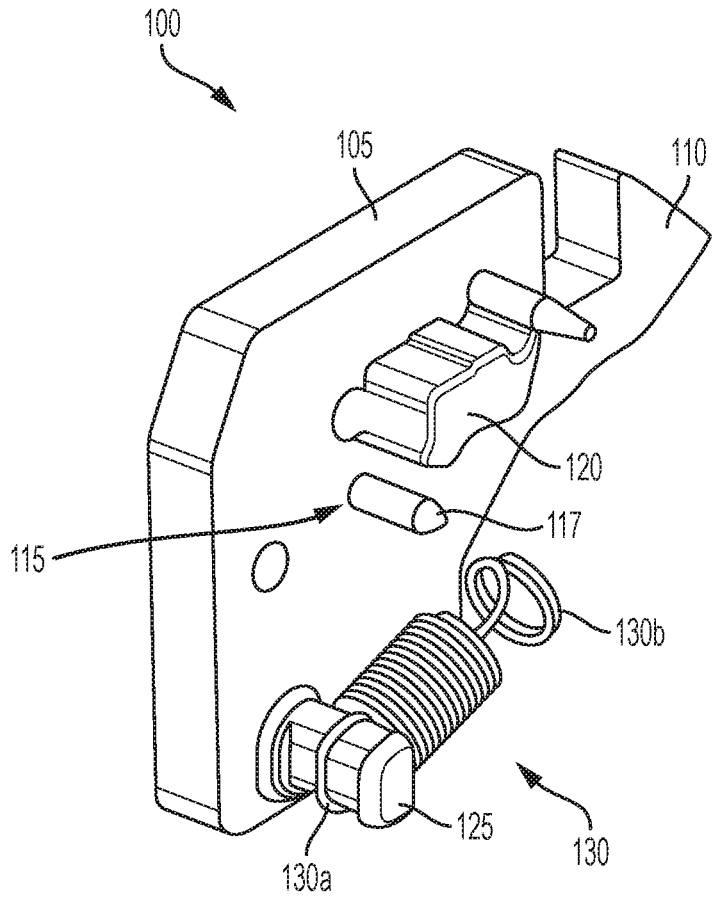
FIG. 1 is a perspective view of a latch according to at least some of the presently disclosed embodiments.

While the present invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention broadly includes pre-molded or pre-assembled fasteners provided within a latch. The latch fastener itself can include a threaded portion and a lead in portion that is longer than the threaded portion. The lead in portion can be inserted into a cavity of a drawer to help align the latch against the cavity during installation. The built-in nature of the fastener allows a user to free one hand during installation, rather than guide the fastener through the latch and into the cavity, and the additional length of the lead in allows an easier alignment of the latch during installation. The latch is therefore easier to install with greater efficiency.

Figure 2:
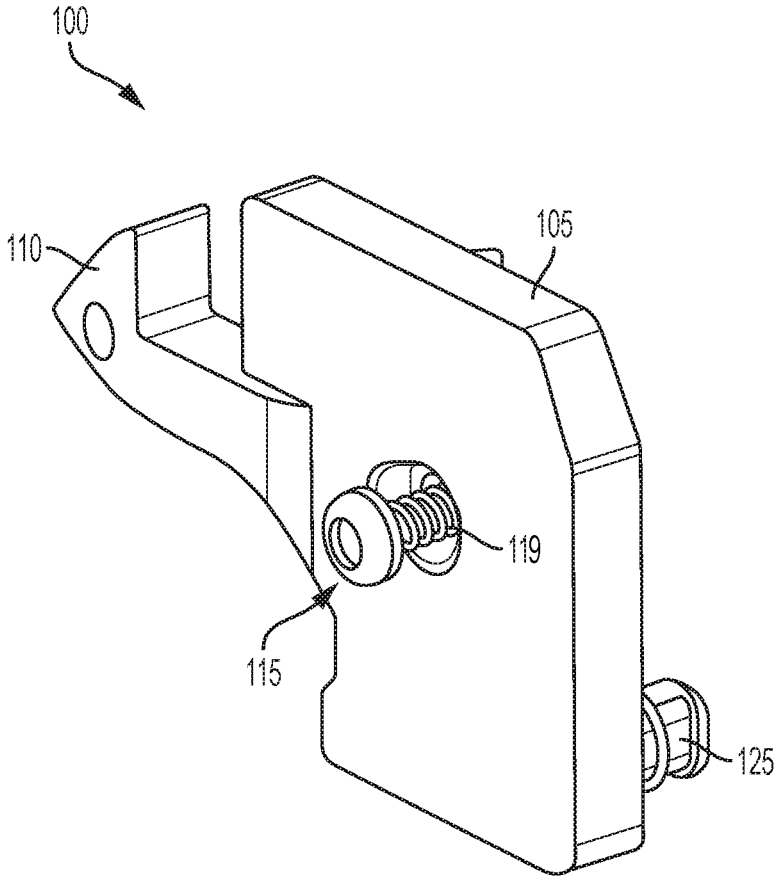
FIG. 2 is a perspective view of a latch according to at least some of the presently disclosed embodiments.
Figure 3:
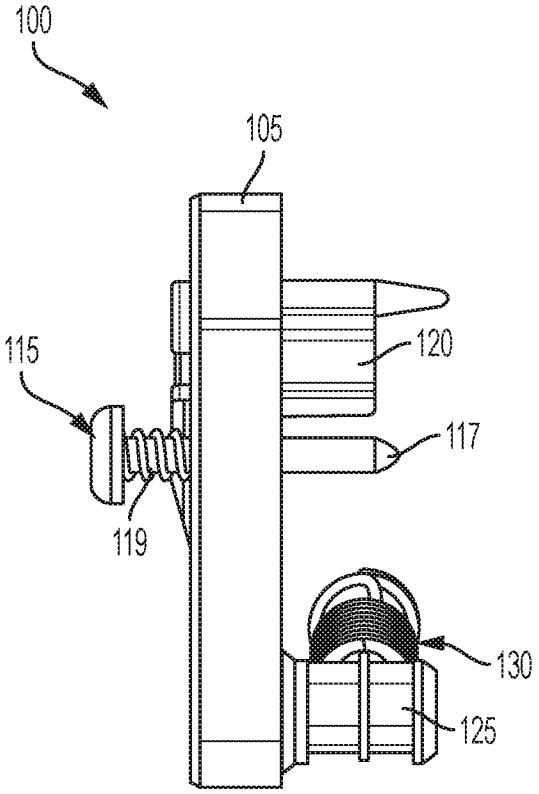
FIG. 3 is a side view of a latch according to at least some of the presently disclosed embodiments.

Referring to FIGS. 1-3, in an embodiment, a latch 100 can include a cover plate 105 and a hook 110 extending from the cover plate 105. A fastener 115 can be located on the cover plate 105 and can include a lead in portion 117 and a threaded portion 119. The latch 100 can further include a base 120 that connects with a corresponding shape in a cavity of a drawer to facilitate a secure connection between the latch 100 and drawer. A post 125 can also extend from the cover plate 105 and can serve as the connection point for a spring 130 with a first end **130*a* and a second end 130*b***.

The cover plate 105 acts as the structural backbone of the latch 100 and can be any shape or structure that provides this function. The cover plate 105 can further serve as a cover to a cavity on a drawer when the latch 100 is coupled to the drawer, as discussed below in more detail. The cover plate 105 can also include various apertures for one or more fasteners 115 to insert through so as to couple the latch 100 to the drawer.

The hook 110 can be any structure capable of holding the drawer in the closed position during use. For example, the hook 110 can have a shape and structure as shown in FIGS. 1 and 2, with a slanted surface and a notch. This design allows the latch 100 to engage the hook 110 into a catch or other structure of the drawer or cabinet by abutting the slanted portion against the catch, pushing the latch 100 downwardly as the drawer is inserted into the cabinet. During this process, the latch 100 will be biased in the upward locked against the catch due to the spring 130. The spring 130 will continue to bias the latch 100 in an upwardly position until the drawer is pushed inwardly past the slanted portion and into the notch of the hook 110 in a closed position. At this point, the latch 100 will be in the locked position, where opening of the drawer will be substantially prevented by the hook 110. To open the drawer, the hook 110 can be removed from the catch by a handle, key, or any other well-known means.

The fastener 115 can be any known fastener, such as a screw, nail, tack, rod, pin, bolt, or any other structure capable of coupling two objects together. As shown, the fastener 115 can include a lead in portion 117 and a threaded portion 119. The lead in portion 117 can be larger than the threaded portion 119 to allow the fastener 115 to substantially align the latch 100 with a cavity of a drawer or other enclosure. For example, the fastener 115 can be inserted into a screw boss located in the cavity with the lead in portion 117 providing a point of alignment, and the threaded portion 119 following as a section that couples the fastener into the screw boss or other receiving portion. In some embodiments, the lead in portion 117 is longer than the threaded portion 119 to allow the fastener 115 to first align itself and then couple with the receiving portion. The smaller threaded portion 119 also allows for a quicker and easier assembly process by providing fewer threads to rotate through before the fastener 115 is completely inserted.

In some embodiments, the fastener 115 can be a nail, e.g. a ring shank nail, that is pre-molded or integrally formed into the cover plate 105 and that can be hammered or otherwise impacted to couple the latch 100 to the drawer. In this embodiment, the installation process is simpler because the user can push the latch 100 against the drawer to establish a weak connection, and hammer or otherwise impact the fastener 115 to complete the coupling and assemble the latch 100 to the drawer.

The base 120 can provide yet another alignment feature to improve the installation process of the latch 100. For example, the base 120 can be a male portion of the latch 100 that inserts into a correspondingly-shaped female portion of the drawer. The base 120 can press-fit or otherwise couple with the corresponding female portion to provide a temporary coupling between the latch 100 and drawer. The latch 100 can thereafter be coupled securely to the drawer by inserting the fastener 115 into the drawer.

The post 125 can serve as an anchor for the spring 130 on the latch 100 side of the spring 130. For example, the post 125 can receive and couple with the first end 130*a* of the spring 130, and the second end 130*b* of the spring 130 can couple with a post or other structure within the drawer to maintain the hook 110 in the locked position, as described above. The spring 130 can be any elastic member capable of providing this bias, for example a coil spring, leaf spring, elastic material, or any other structure or material that can provide a bias.

Figure 4:
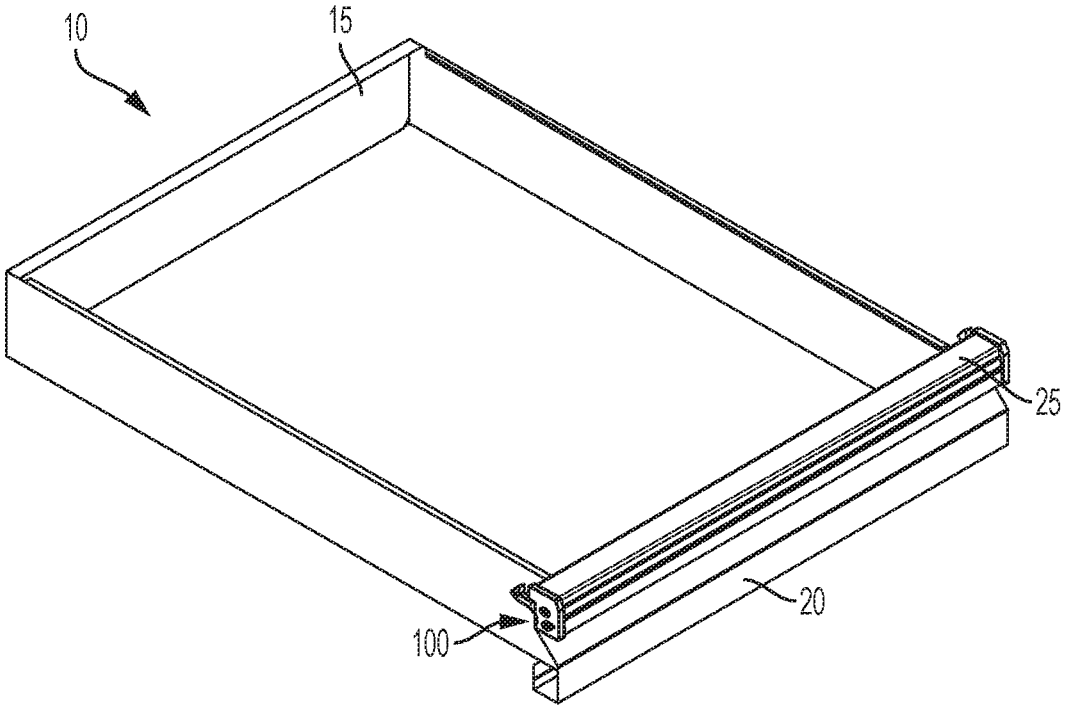
FIG. 4 is a perspective view of a slide drawer with latch installed according to at least some of the presently disclosed embodiments.
Figure 5:
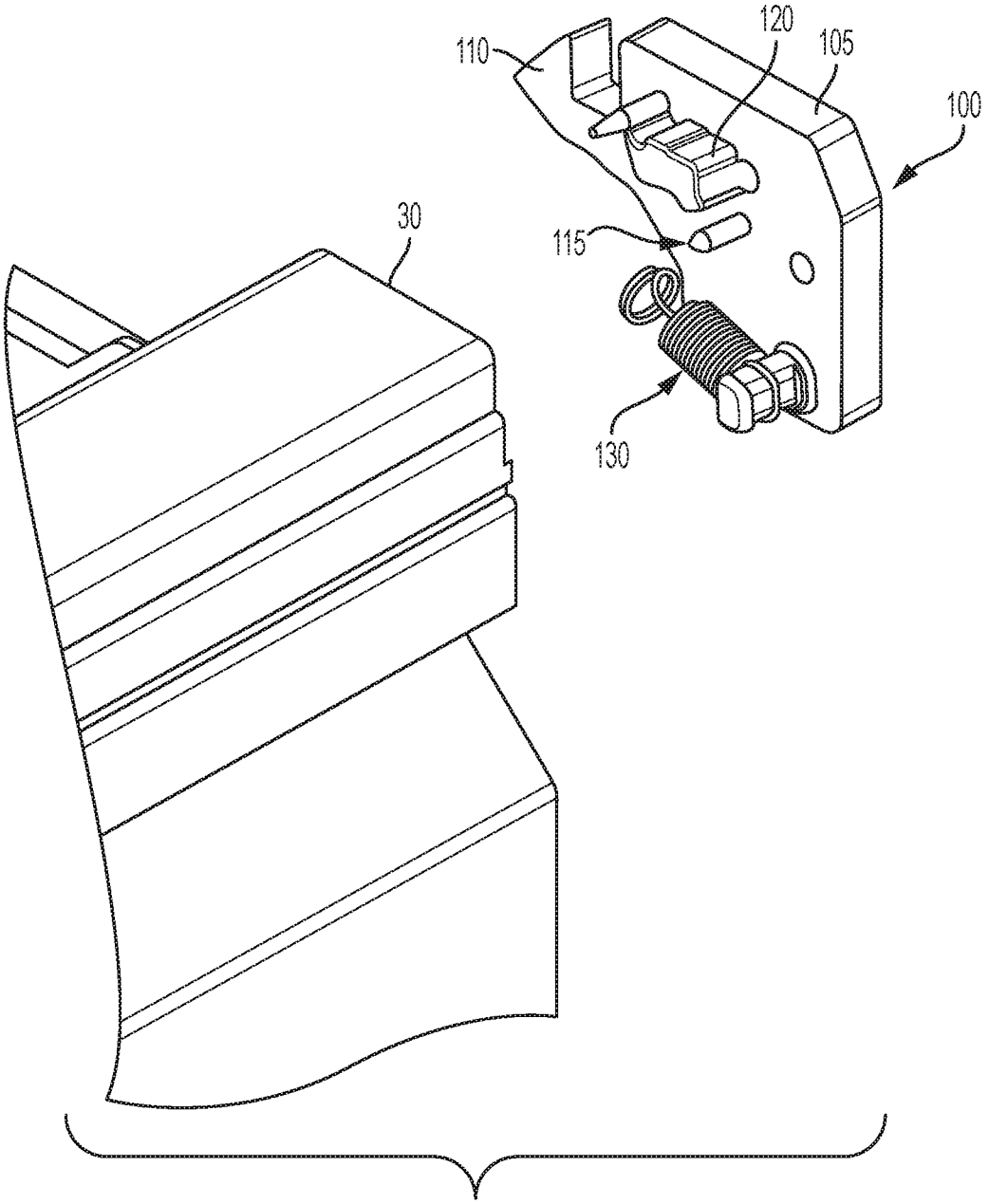
FIG. 5 is a perspective view of a latch disassembled from a slide drawer according to at least some of the presently disclosed embodiments.
Figure 6:
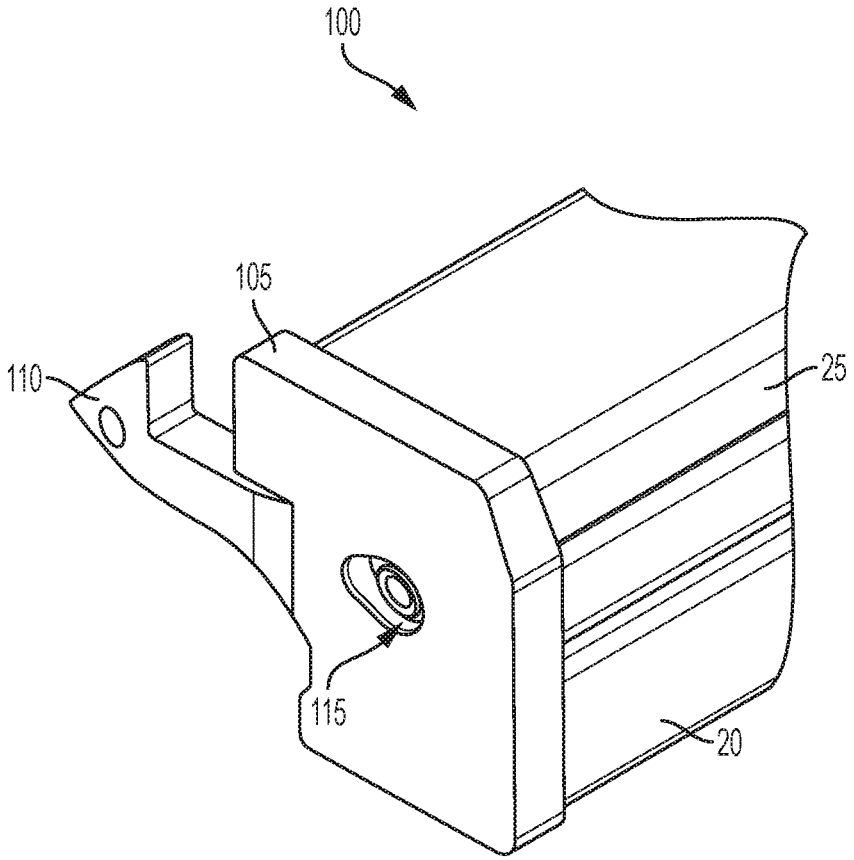
FIG. 6 is a perspective view of a latch installed in a slide drawer according to at least some of the presently disclosed embodiments.
Figure 7:
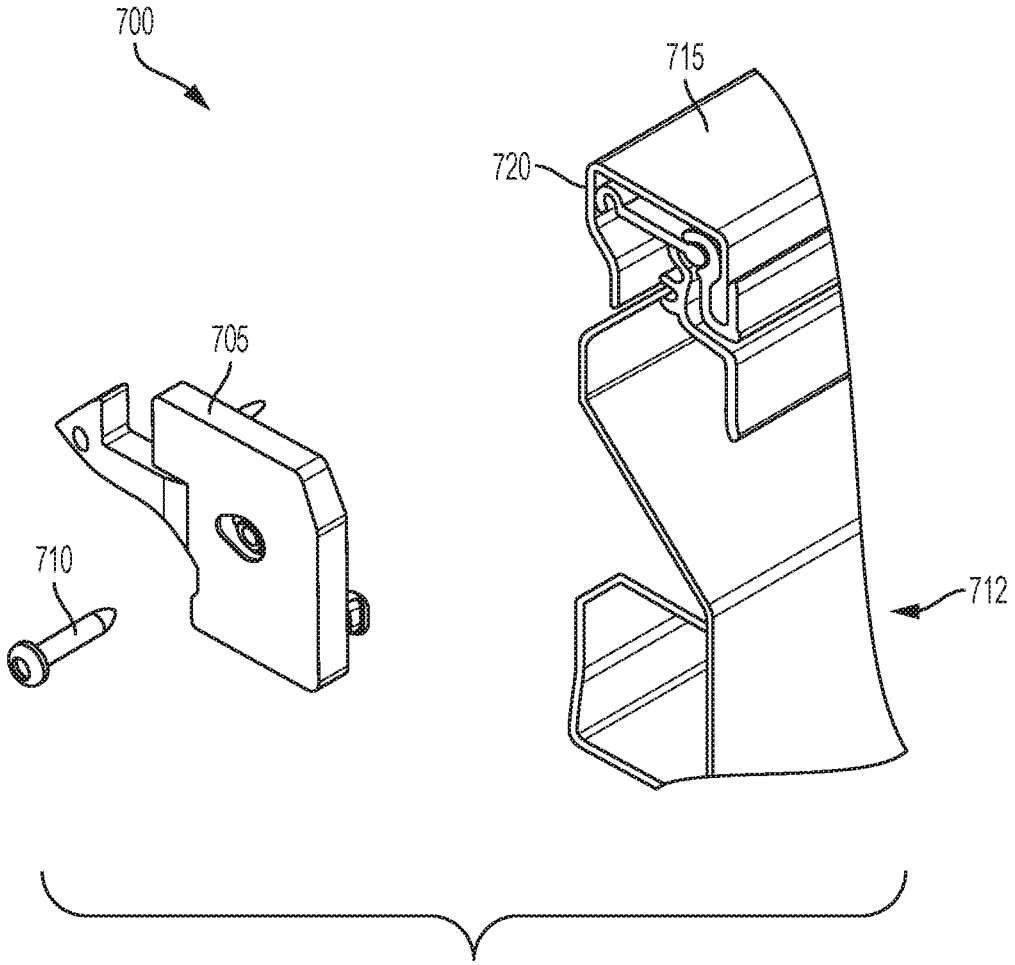
FIG. 7 PRIOR ART
FIG. 7 is a perspective view of a prior art latch and drawer system.

Referring to FIGS. 4-6, a drawer 10 with the latch 100 coupled or being coupled inside is shown. As shown, the drawer 10 can include an enclosure 15 for holding objects, such as tools or fasteners, assuming the cabinet holding the drawer is a toolbox. The drawer 10 can include a face 20 that encloses the drawer 10 when in the closed position, and a handle or grip 25 that a user can grip to open the drawer 10. As shown in FIG. 5, and as described above in more detail, the drawer 10 can include a cavity 30 that the latch 100 inserts into for coupling and assembly.

As discussed herein, the drawer 10 can be inserted into a toolbox or tool cart. However, the present invention is not so limited and the drawer 10 and latch 100 can be utilized in any other capacity, for example, in a dresser, chest, nightstand, desk, or any other piece of furniture or other structure in which drawers are used. Further, the latch 100 need not be included with a drawer and can be a latch for a cabinet door or other structure.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A method of installing a latch for a drawer comprising:

providing a latch including a handle having opposing first and second ends, a cover plate disposed at one of the first and second ends, and a hook extending from the cover plate; and assembling a fastener to the cover plate prior to installation of the latch on the drawer, wherein the fastener includes a threaded portion and a lead-in portion, and wherein the lead-in portion is longer than the threaded portion and extends from the cover plate; and aligning the latch with the drawer using the lead-in portion.

2. The method according to claim 1, further comprising coupling the fastener to the drawer by engaging the fastener into the drawer.

3. The method according to claim 2, further comprising coupling a spring to the latch and the drawer to bias the latch into a locked position.

4. The method according to claim 2, wherein the step of coupling the fastener includes coupling the fastener into a cavity disposed in the drawer, and wherein the cover plate substantially covers the cavity.

5. The method according to claim 3, wherein the spring includes first and second ends, and wherein the first end is coupled to the latch at a post and the second end is coupled to the drawer.

6. A latch for a cabinet having a catch comprising:

a handle having opposing first and second ends;

a cover plate disposed at one of the first and second ends;

a hook extending from the cover plate and adapted to engage with the catch of the cabinet;

a fastener assembled to the cover plate prior to installation of the latch, wherein the fastener includes a threaded portion and a lead-in portion that is longer than the threaded portion, and wherein the lead-in portion extends from the cover plate and is adapted to align the latch relative to the cabinet; and a spring adapted to bias the latch into a locked position when engaged against the catch.

7. The latch of claim 6, further comprising a post extending from the cover plate, wherein the spring is coupled to the post at a first end and coupled to a drawer adapted to be disposed in the cabinet at a second end opposite the first end.

8. The latch of claim 6, further comprising a base extending from the cover plate, wherein the base is adapted to couple with a corresponding female portion disposed in a cavity of a drawer.

9. A latch for a cabinet having a catch, comprising:

a handle having opposing first and second ends;

a cover plate disposed at one of the first and second ends and including a fastener assembled to the cover plate prior to installation of the latch, wherein the fastener includes a threaded portion and a lead-in portion extending from the cover plate, and wherein the lead-in portion is longer than the threaded portion, and the lead in portion is adapted to align the latch against the cabinet;

a hook extending from the cover plate and adapted to engage the catch of the cabinet; and a spring adapted to bias the latch into a locked position when engaged against the catch.

10. The latch of claim 9, further comprising a post extending from the cover plate, wherein the spring is coupled the post at a first end and coupled to a drawer that is adapted to be slidably disposed in the cabinet at a second end opposite the first end.

11. The latch of claim 9, further comprising a base extending from the cover plate, wherein the base is adapted to couple with a corresponding female portion of a drawer.

12. A method of installing a latch for a drawer comprising:

providing a latch, a cover plate, and a hook extending from the cover plate;

molding a fastener into the cover plate prior to installation of the latch on the drawer, wherein the fastener extends from the cover plate; and aligning the latch with the drawer using the lead in portion.

13. The method according to claim 12, further comprising coupling the fastener to the drawer by engaging the fastener into the drawer.

* * * * *